US009895285B2

(12) United States Patent
Ingrassia

(10) Patent No.: US 9,895,285 B2
(45) Date of Patent: Feb. 20, 2018

(54) HOT STONE THERAPY AND ACUPRESSURE APPARATUS AND METHOD

(76) Inventor: Patrick Lee Ingrassia, Amherst, NY (US)

( * ) Notice: Subject to any disclaimer, the term of this patent is extended or adjusted under 35 U.S.C. 154(b) by 1093 days.

(21) Appl. No.: 13/559,045

(22) Filed: Jul. 26, 2012

(65) Prior Publication Data

US 2013/0030332 A1 Jan. 31, 2013

Related U.S. Application Data

(60) Provisional application No. 61/511,814, filed on Jul. 26, 2011.

(51) Int. Cl.
*A61H 7/00* (2006.01)
*A61H 15/00* (2006.01)
(Continued)

(52) U.S. Cl.
CPC ..... *A61H 15/0092* (2013.01); *A61H 7/00* (2013.01); *A61H 7/002* (2013.01); *A61H 7/003* (2013.01); *A61H 7/007* (2013.01); *A61H 15/00* (2013.01); *A61H 15/02* (2013.01); *A61H 39/00* (2013.01); *A61H 39/04* (2013.01); *A61H 2015/0007* (2013.01); *A61H 2015/0014* (2013.01); *A61H 2015/0021* (2013.01);
(Continued)

(58) Field of Classification Search
CPC ..... A61H 2201/16; A61H 7/00; A61H 7/007; A61H 7/002; A61H 7/003; A61H 15/00; A61H 2015/0007; A61H 2015/0014; A61H 2015/0028; A61H 2015/0035; A61H 2015/0042; A61H 2015/005; A61H 2015/0064; A61H 15/0092; A61H 39/04; A61H 2201/0207; A61H 2201/0221; A61H 2201/1253; A61H 2201/1623; A61B 17/12
USPC ..... 606/201, 204; 601/112, 122, 118, 119, 601/120, 121, 123, 125, 127, 129, 131, 601/134, 135, 136, 137
See application file for complete search history.

(56) References Cited

U.S. PATENT DOCUMENTS 1,026,481 A * 5/1912 Ward ..... 601/135
1,265,083 A * 5/1918 Hoard ..... 601/118
(Continued)

FOREIGN PATENT DOCUMENTS

WO WO 9421211 A1 * 9/1994 ..... A61H 15/00

OTHER PUBLICATIONS

Patrick Mitchell ("Central Heating, Installation, Maintenance and Repair", 2008, p. 99).*

*Primary Examiner* — Justine Yu
*Assistant Examiner* — Tu Vo
(74) *Attorney, Agent, or Firm* — Vincent G. LoTempio; Kloss, Stenger & LoTempio; David T. Stephenson

(57) ABSTRACT

A hot stone therapy and acupressure roller including a specially designed rod where hollow, cylindrical stones, along with acupressure pins, are spaced along the rod. As the rod is applied to the body, the attached stones roll and acupressure may be applied. Targeted acupressure can be applied on either side of the rod, and the acupressure pins serve to bold the cylindrical stones and spacers in place. The stones can be inserted onto the rod or used individually. The stones can be used to conduct a cold and/or hot stone massage. Additionally, each end of the rod is shaped for use
(Continued)

as a massage tool. When using either end of the rod as a massage tool, the acupressure pins serve to improve grip and increase leverage.

15 Claims, 6 Drawing Sheets

(51) Int. Cl.
*A61H 15/02* (2006.01)
*A61H 39/00* (2006.01)
*A61H 39/04* (2006.01)

(52) U.S. Cl.
CPC ..... *A61H 2015/0028* (2013.01); *A61H 2015/0035* (2013.01); *A61H 2201/0107* (2013.01); *A61H 2201/0153* (2013.01); *A61H 2201/0157* (2013.01); *A61H 2201/02* (2013.01); *A61H 2201/0207* (2013.01); *A61H 2201/0257* (2013.01); *A61H 2201/169* (2013.01); *A61H 2205/081* (2013.01)

(56) References Cited

U.S. PATENT DOCUMENTS 2,104,494 A * 1/1938 O'Brien, Jr. ..... 43/18.1 R
3,858,579 A * 1/1975 Ching ..... 601/120
3,994,289 A * 11/1976 Thomas et al. ..... 601/120
4,433,683 A * 2/1984 McCoy ..... A63B 21/05 601/120
4,493,315 A * 1/1985 Iwahashi ..... 601/135
4,648,387 A * 3/1987 Simmons ..... 601/120
5,251,620 A * 10/1993 Boucher et al. ..... 601/122
5,364,338 A * 11/1994 Terashima ..... 601/120
5,577,995 A 11/1996 Walker et al.
5,577,996 A 11/1996 Gardner et al.
5,843,005 A * 12/1998 Chubinsky ..... 601/15
5,979,006 A * 11/1999 Stokes ..... A61H 11/00 15/222
6,241,693 B1 * 6/2001 Lambden ..... 601/15
6,389,960 B1 * 5/2002 Williams et al. ..... 99/339
6,551,261 B1 4/2003 Jun
D484,248 S * 12/2003 O'Brien ..... D24/214
6,758,826 B2 * 7/2004 Luettgen ..... A61H 19/34 601/135
2003/0083600 A1 * 5/2003 Robbins et al. ..... 601/133
2004/0254508 A1 * 12/2004 Lee ..... 601/119
2005/0096572 A1 * 5/2005 Hua ..... 601/135
2008/0103421 A1 * 5/2008 Nicholson ..... A61H 15/0092 601/120
2008/0200851 A1 * 8/2008 Faussett ..... 601/119
2011/0245741 A1 * 10/2011 L'Homme et al. ..... 601/120
2011/0257569 A1 * 10/2011 Robins ..... 601/137
2011/0313333 A1 * 12/2011 Nicholson ..... 601/120

* cited by examiner

HOT STONE THERAPY AND ACUPRESSURE APPARATUS AND METHOD

CROSS-REFERENCE TO RELATED APPLICATION

This application claims the benefit of U.S. Provisional Application No. 61/511,814, filed Jul. 26, 2011.

BACKGROUND OF THE INVENTION

1. Field of the Invention

This patent application relates to a massage apparatus and method which employs a rod and/or stones in performing massage therapy with clients. More specifically this patent application relates to a massage apparatus and method which incorporates a specially designed rod with removable attachments and the use of stones which can be inserted onto the rod or used individually. The stones can further be used to conduct a cold and/or hot stone massage.

2. Background

Traditional hot stone massage therapy employs large, flat stones which are heated in a hot water bath. The stones are then extracted from the bath and rubbed on a patient's back or limbs. Traditional hot stone massage has a number of limitations. First, there is a potential for burns to both the massage therapist as well as the patient. Patient burns also raise the specter of potential lawsuits. Indeed, there have been specific instances of patient burns from hot stone massage before the courts. Second, the stones are relatively thin and flat. During a massage, one surface is housed in the hand of the therapist while the opposite surface contacts the body of the patient. All of this contact causes the stones to quickly cool thereby requiring exchanging of the stones to maintain proper heat. However, exchanging stones presents its own drawbacks. First, the stones are in a hot water bath making it difficult and dangerous to extract stones from the bath. Second, massage oils are frequently used in conjunction with the hot stones. The oil/water mixture causes the stones to become very slippery. The slippery stones are difficult to control and only superficial treatment can be provided. The too hot, slippery stones do not allow for deep tissue massage. Finally, cooling of the stones and their constant exchanging requires a large number of stones to be prepared causing hot stone massage to be labor intensive, particularly when cleaning the stones between uses to ensure that there is no bacterial buildup on the stones.

An alternative massage technique utilizes a bamboo rod where the bamboo rod is designed to work on various parts of the body to maximize leverage and gravity with sliding, rolling, kneading, pivoting, levering, tapping and friction techniques. The bamboo rod allows a therapist to provide greater pressure to the client permitting a deeper massage. Further, the use of the rod reduces the amount of stress of the wrists and thumbs of the therapist, thereby extending a therapist's career. However, there are significant drawbacks to a massage performed solely with a bamboo rod. First, rolling the rod along the back can impact on the spine and cause the patient pain. Second, if oil is used in conjunction with the bamboo, the surface of the rod becomes slippery, negatively impacting the amount of pressure that can be applied to the body. Last, although a rod is used, the massage therapist is still required to use a great deal of force to conduct the massage. This required force tires the therapist and can lead to injury or a shortened career. Importantly, deep tissue or acupressure massage is not possible with existing bamboo rods as these rods have flat ends perpendicular to the long axis of the rod. These flat ends present sharps edges unsuitable for use in massage.

Thus, it is readily apparent that there is a long-felt need for a massage apparatus which permits a massage therapist to perform both hot stone massage and bamboo massage without the need for oils or lubricants. More particularly, there is a need for a massage apparatus which allows for hot stone massage without injuring either the therapist or the patient while also allowing for bamboo massage with increase leverage and pressure thereby providing deeper massage without overly stressing the therapist.

SUMMARY OF THE INVENTION

It is accordingly an object of the present invention is to provide a massage apparatus capable of performing numerous massage therapy techniques including hot stone massage and bamboo massage without the need for oils or lubricants.

Still another object of the present invention is to provide a massage apparatus capable of performing numerous massage therapy techniques including hot stone massage and bamboo massage where hot stones are generally donut-shaped and are placed on a bamboo rod.

A further object of the present invention it to provide a massage apparatus capable of performing numerous massage therapy techniques including hot stone massage and bamboo massage while also including additional tools to perform deep tissue massage.

The above and other objects are accomplished in accordance with the present invention which comprises a hot stone therapy and acupressure apparatus comprising a rod having an outer diameter, a first end, a second end and a middle section, at least one stone removably mounted on the rod, wherein each stone is shaped as a hollow cylinder defining an interior surface and an exterior surface, with the interior surface having a diameter that is slightly larger than the outer diameter of the rod wherein each stone is independently axially movable and positionable along the middle section of the rod, the first end and said second end portions of the rod extending beyond the at least one stone thereby forming a pair of handles for facilitating gripping the rod and positioning the apparatus across a person's body, and at least one acupressure pin removably mounted to the rod for positioning, removing and replacing the at least one stone and for applying acupressure to said person's body.

BRIEF DESCRIPTION OF THE DRAWINGS

The present invention and the manner in which it may be practiced is further illustrated with reference to the accompanying drawings wherein.

DESCRIPTION OF SPECIFIC EMBODIMENTS

Figure 1:
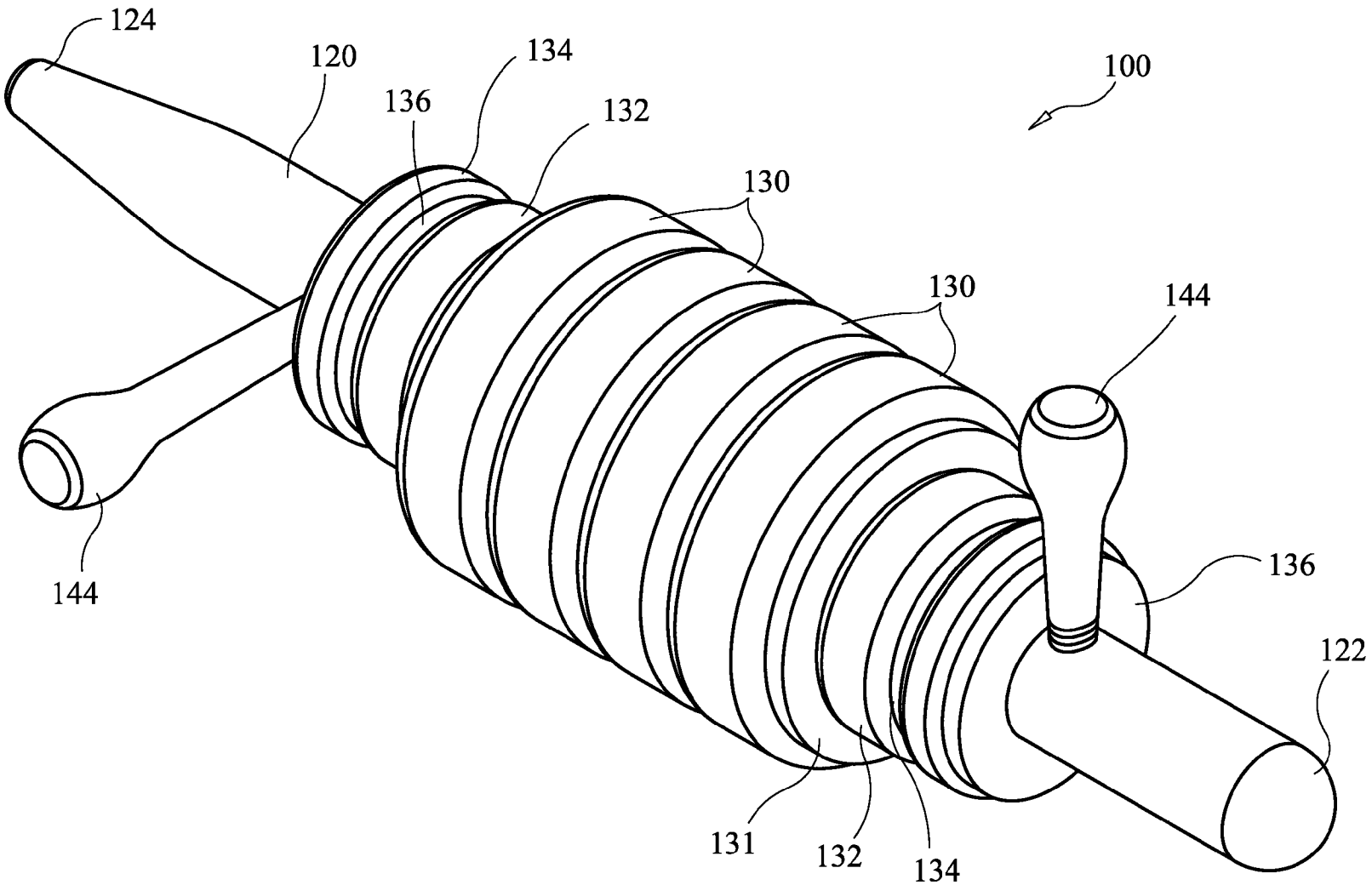
FIG. 1 is a perspective view of one embodiment of the present invention.

At the outset, it should be clearly understood that reference numerals are intended to identify the information found in the block diagrams in the several drawing figures, as may be further described or explained by the entire written specification of which this detailed description is an integral part. The drawings are intended to be read together with the specification and are to be construed as a portion of the entire "written description" of this invention as required by 35 U.S.C. §112.

A hot stone therapy and acupressure apparatus is disclosed, comprising a rod having an outer diameter, a first end, a second end and a middle section, at least one stone removably mounted on the rod, wherein each stone is shaped as a hollow cylinder defining an interior surface and an exterior surface, with the interior surface having a diameter that is slightly larger than the outer diameter of the rod wherein each stone is independently axially movable and positionable along the middle section of the rod, the first end and said second end portions of the rod extending beyond the at least one stone thereby forming a pair of handles for facilitating gripping the rod and positioning the apparatus across a person's body, and at least one acupressure pin removably mounted to the rod for positioning, removing and replacing the at least one stone and for applying acupressure to said person's body.

Adverting now to the drawings, with reference to FIG. 1, a preferred embodiment of the hot stone therapy and acupressure apparatus (also referred to as a massage apparatus) of the present invention is indicated generally by numeral 100. Massage apparatus 100 is generally comprised of rod 120; stones 130, spacers 131, 132, 134, and 136; and removable acupressure pins 144. Rod 120 is generally cylindrical of a suitable diameter for conducting a massage. In a preferred embodiment, each end of rod 120 is rounded over with end 122 having a blunt profile while end 124 has a longer, more tapered profile. Proximate each end of rod 120 are blind threaded holes into which acupressure pins 144 are removably inserted. Preferably, the first blind threaded hole is oriented ninety degrees from the orientation of the second blind threaded hole for the purpose of allowing a therapist to apply targeted acupressure simultaneously with a rolling hot stone therapy. The ninety degree offset orientation also gives the therapist more leverage when using ends 122, 124 of rod 120 for acupressure purposes.

Rod 120 can be constructed of any suitable material including wood, metal, or plastic. Preferably, rod 120 is composed of a dense hardwood such as black walnut, and more preferably constructed of laminated bamboo. Stones 130 are generally hollow cylinders having an interior diameter slightly larger than the diameter of rod 120 such that the stones can slide on to and off of the rod. Preferably, stones 130 are selected to accept and hold heat for a long period of time without significant cooling of the stones. Stones 130 are preferably made out of soapstone or some other very dense stone with a high specific heat capacity, such as jade, basalt or marble, but can also be constructed of any other suitable material, including wood, metal, or plastic. Soapstone in particular has a specific heat capacity of 0.98 J/g K, compared to basalt rock, which has a specific heat capacity of 0.84 J/g K or marble, which has a specific heat capacity of 0.88 J/g K. Stones 130 are also preferably high in mass, non-porous (i.e. hypoallergenic), and non-stick (thereby applying less friction to the spacers 131, 132, 134, and 136 and the rod 120). Stones 130 can be used to conduct a hot stone massage. Stones 130 can be used in conjunction with rod 120 for a rolling hot stone massage or without rod 120 as individual massage stones or as placement stones for use in a traditional hot stone massage. Additionally, stones 130 can also be used as cold therapy stones, or alternate hot & cold stones can be used.

Stones 130 are preferably beveled on both the interior and exterior surfaces with an approximate ⅜" radius. The bevel of stone 130 can be rounded further, which will create the effect of a deeper tissue massage when rolled over the body of a person. A perfectly flat exterior surface of stone 130 would pinch and pull the hair off the skin of a user if multiple flat stones 130 were placed directly next to each other on rod 120. By having multiple stones 130 directly next to each other on rod 120, this limits where heat from the stones can dissipate, thereby allowing them to cool less quickly. Similarly to the problem with stones 130 having a flat exterior surface, a perfectly flat interior surface of stone 130 would cause more wear and tear to rod 120 when stones 130 are being rolled using rod 120 as an axis.

Spacers 131, 132, 134, and 136 are generally ring-shaped discs of various diameters. Each spacer has an integrated hole in its center having a diameter slightly larger than the diameter of rod 120 such that the spacers can slide on to and off of the rod. Spacers 131 have the largest diameter of the set of spacers 131, 132, 134, and 136, while spacers 132 have the widest surface of the set of spacers 131, 132, 134, and 136. Spacers 131, 132, 134, and 136 can be constructed of any suitable material, including wood, metal, plastic, or stone. Spacers 136 have the smallest external diameter of the set of spacers 131, 132, 134, and 136. Spacers 136 are also the thinnest of the spacers. Spacers 136 are primarily used to create gaps between stones 130, and/or spacers 131, 132, and/or 134, and are preferably constructed of a minimally heat conductive material such as wood or plastic. More preferably, spacers 136 are constructed of suitable plastic due to their thin cross-section as wood of this thickness would crack and splinter over the course of repeating heating and cooling caused by stones 130 during a hot stone massage. Spacers 134 are of intermediate external diameter of the set of spacers 131, 132, 134, and 136. As shown, these spacers can have different cross-sectional widths (e.g. spacers 134 have a wider cross-section than spacers 136). Spacers 134 and 136 are employed as spacers and also function as buffers during hot stone massage. Spacers 134 and/or 136 are placed proximate the ends of rod 120 with stones 130 nested between spacers 134 and/or 136. The hands of the therapist do not come into direct contact with hot stones 130 but are in contact with either spacers 134 and/or 136, or acupressure pins 144. Spacers 134 and 136 are constructed of any suitable insulating material such as wood or plastic. Preferably, spacers 134 and 136 are constructed of wood merely for aesthetic purposes.

Massage apparatus 100 also preferably comprises two acupressure pins 144. As shown in FIG. 1, an acupressure pin is inserted into each blind threaded hole on rod 120 to constrain the stones and spacers on the rod. Acupressure pins 144 are also employed as handles to provide additional leverage when using rod 120 in a deep tissue massage. The ends of acupressure pins 144 can themselves be used to conduct deep tissue massage. Massage apparatus 100 will allow the therapist to apply two types of pressure spots on a patient's body simultaneously by using a combination of rolling stones 130 along with sliding acupressure pins 144. Massage apparatus 100 can also be used as a percussion tool in a slide-hammer application.

Massage apparatus 100 has numerous unexpected results as a consequence of its design. Generally in hot stone therapy, hot stones are moved across a patient's skin by sliding, requiring the application of oils or lubricants to the skin and/or stone to facilitate the sliding action. A major advantage of massage apparatus 100 over tools currently used in the industry is that, due to the rolling stone feature of massage apparatus 100, oils or lubricants are not needed to perform hot stone therapy. In the instant disclosure, hot stone therapy is applied to a patient directly over sheets, draping, clothing, or on the skin, without the need for hot oils to be used at all. An oil-free hot stone therapy reduces injury risk both to the patient and to the therapist, accommodates modest patients who prefer to stay clothed during therapy, and also does not require the patient to bathe afterwards to remove any leftover oils. Hot stone therapy is completed in much less time using massage apparatus 100. In addition, because rod 120 has acupressure components built into it (i.e. acupressure pins 140, 144), oils or lubricants are also not needed to perform acupressure on a patient using a sliding rod technique.

An additional unexpected result of massage apparatus 100 comes as a result of the design of stones 130. Traditionally, stones used for hot stone therapy are rounded about their surface, and are heated using water, which is a time-consuming process. However, in the instant disclosure, because stones 130 are designed with a flat surface on each side (as opposed to a rounded surface), stones 130 can be heated on the surface of a griddle in a fraction of the time it normally takes to heat traditional stones in water.

Yet additional unexpected results of the instant design provide that stones 130 do not have to be handled directly by a therapist while performing hot stone therapy on a patient. Also, added benefits of massage apparatus 100 include increased leverage by the therapist using the handles of rod 120, allowing deeper penetration of stones 130 and/or acupressure pins 140, 144 into targeted areas on the patient's body.

Figure 2:
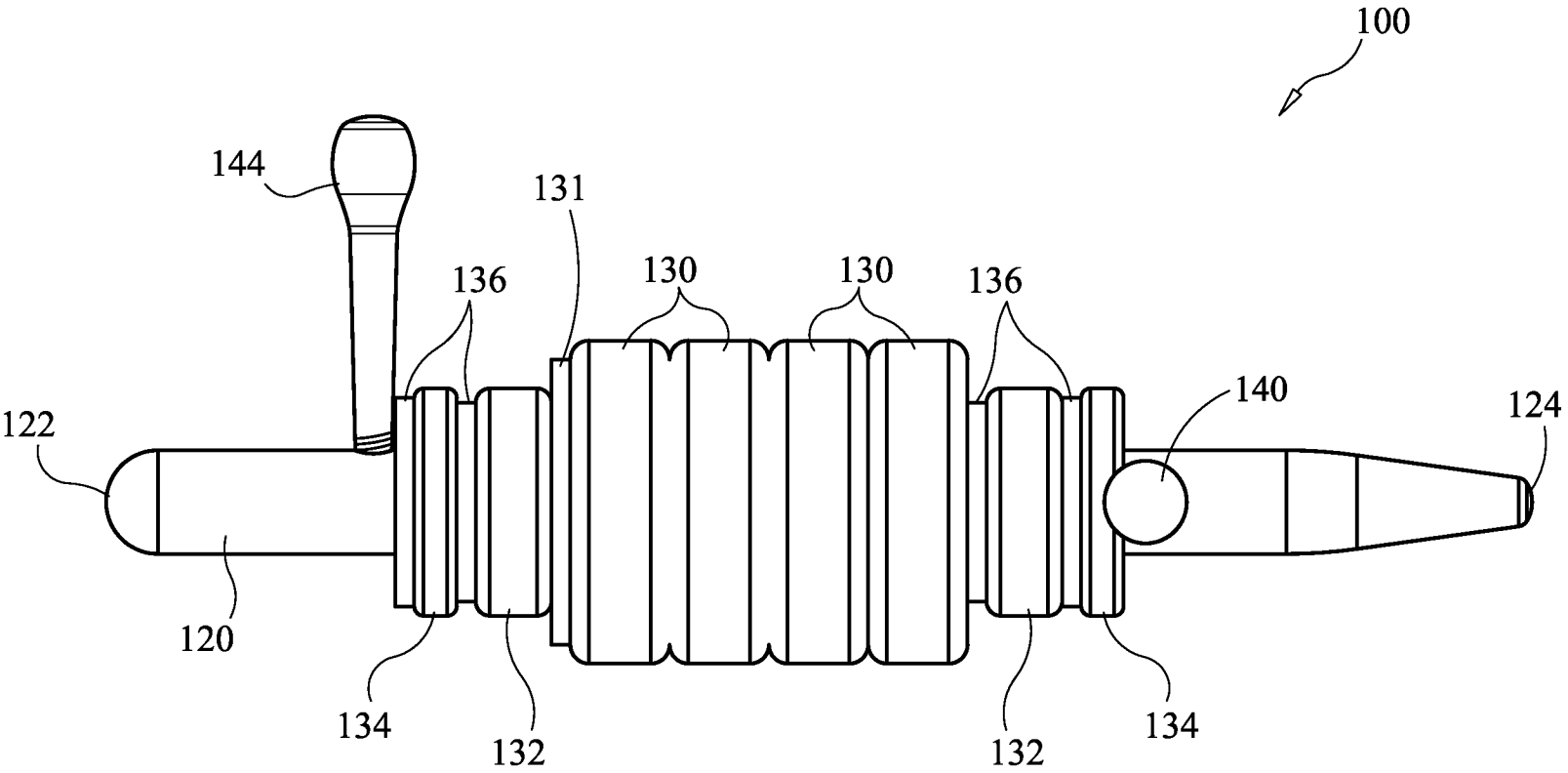
FIG. 2 is a top perspective view one embodiment of the present invention where a short acupressure pin is removably inserted into a through-bore on the tapered end of the rod with a series of stones and spacers removably threaded onto the rod.

FIG. 2 is a top perspective view where short acupressure pin 140 is removably inserted into a blind threaded hole on the tapered end of rod 120. A series of stones 130 and spacers 131, 132, 134, and 136 are then removably slid onto the rod and are held on the rod by long acupressure pin 144, which is removably inserted into a blind threaded hole on the blunted end of rod 120. Additional combinations of stones and spacers can be added to the rod that results in a massage apparatus similar to that shown in FIG. 1 or FIG. 4. Alternatively, the arrangement shown in FIG. 2 can be used to perform a massage where two stones 130 are used on the patient.

FIG. 2 shows side perspective views of ring-shaped stones 130 and spacers 131, 132, 146 and 136 illustrating the differing widths and diameters of the stones and spacers. Each stone and spacer has a similar internal bore which is slightly larger than the diameter of rod 120, but each has differing external diameters. When massage apparatus 100 is used in a rolling massage, the stones 130 contact the patient's body while the smaller spacers 131, 132, 134, and 136 do not contact the patient.

Figure 3:
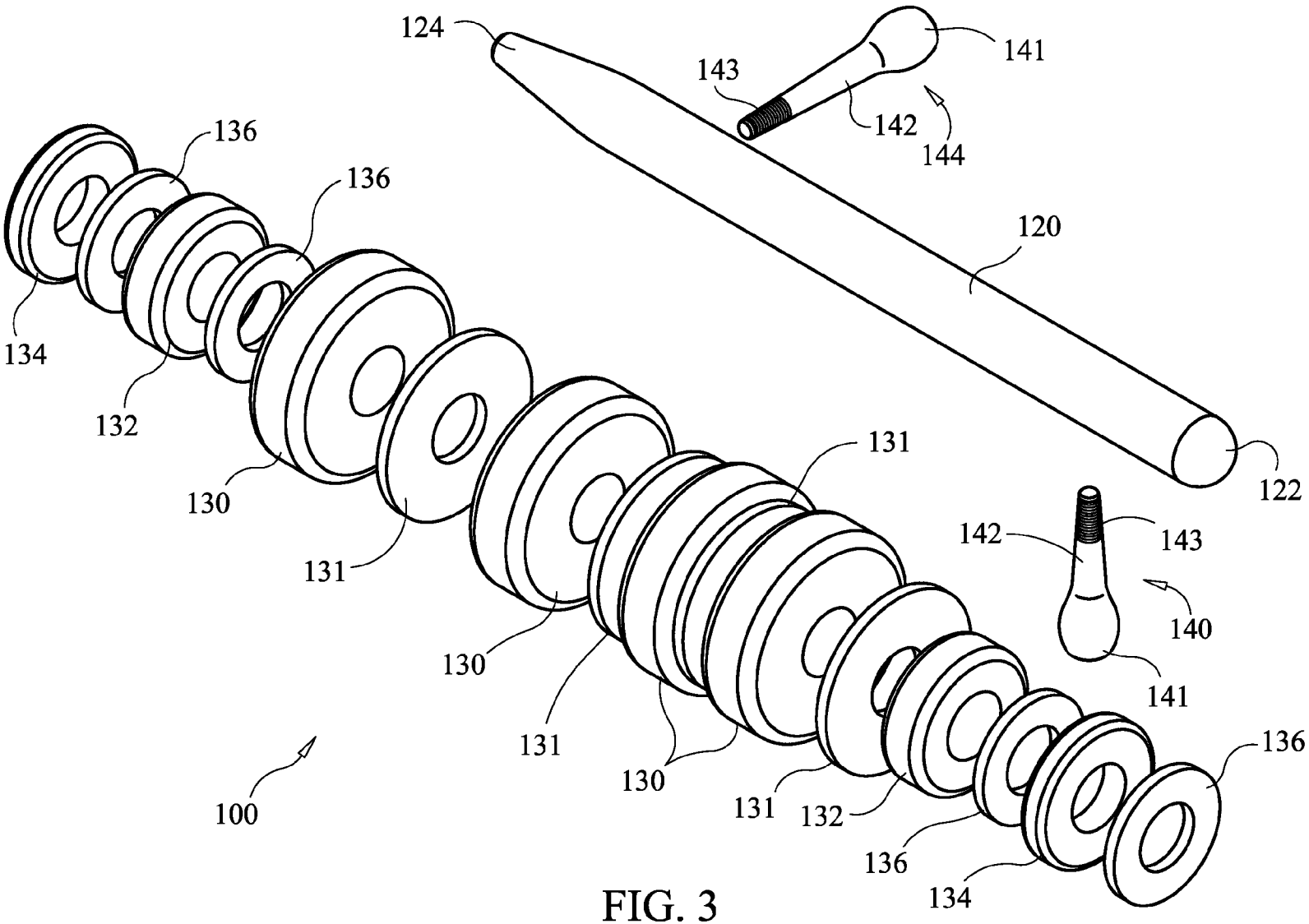
FIG. 3 is an exploded view of the major components comprising one embodiment of the present invention.

A preferred embodiment of massage apparatus 100 is shown in an exploded view in FIG. 3. As seen in the exploded view, rod 120 has acupressure pins 140 or 144 oriented at ninety degree angles from each other proximate each end of rod 120. Two blind threaded holes (not shown) are located proximate blunt end 122 and tapered and 124 of rod 120 for receiving acupressure pins 140, 144. Short acupressure pin 140 has a bulbous end 141 and a tapered shaft 142. Bulbous end 141 can be constructed with varying radii lengths for different degrees of deep tissue massage. Preferably, tapered shaft 142 is constructed with a threaded tip 143 for screwing into a blind threaded hole on rod 120. Alternatively, tapered shaft 142 is constructed so that it can be removably inserted into a through-bore on rod 120 where it is held in place by friction and a wedging action. Long acupressure pin 144 is constructed similarly to short acupressure pin 140 with a bulbous end 141 but has a longer tapered shaft 142. Again, a non-threaded tapered shaft 142 can also be removably inserted into a through-bore on rod 120 where it is held in place by friction and a wedging action. Threaded acupressure pins 140, 144 are preferred over non-threaded acupressure pins because purely tapered pins can get loose after repeated insertions into rod 120.

Acupressure pins 140 and 144, like rod 120, are preferably made out of bamboo. Acupressure pins are preferably removably inserted into rod 120 at a right angle, which will give the therapist the greatest amount of control to place the pressure on one specific spot on the patient's body. Acupressure pins 140, 144 can be used by themselves for acupressure or reflexology. Each of acupressure pins 140 and 144 are also used in conjunction with rod 120, stones 130, and spacers 131, 132, 134, and 136 to perform multiple functions, to be discussed in greater detail in the methods below. Also shown in FIG. 3 are stones 130, as well as the varying external diameters of spacers 131, 132, 134, and 136, and the relative lengths of short acupressure pin 140 in relation to long acupressure pin 144.

The massage apparatus of the present invention can be used to perform a rolling hot stone massage. The assembled massage apparatus 100 is preferably rolled within a common, thermostatically controlled heating pad. The heating pad is then set to the desired temperature such that the stones in contact with the pad are heated while the smaller diameter spacers and rod are not contacted by the pad. Thus, only the stones which are to contact the patient are heated while the remainder of the apparatus remains relatively cool to the touch. When ready for use, the therapist merely unrolls the heating pad, grabs the rod and rolls the stones on the patient. Through use of a heating pad, the therapist does not have to get his or her hands wet as is the case when using a hot water bath. The elimination of water is particularly important when massage oils are used as the apparatus is less slippery making it more easily manipulated in order to provide a more controlled massage.

Figure 4:
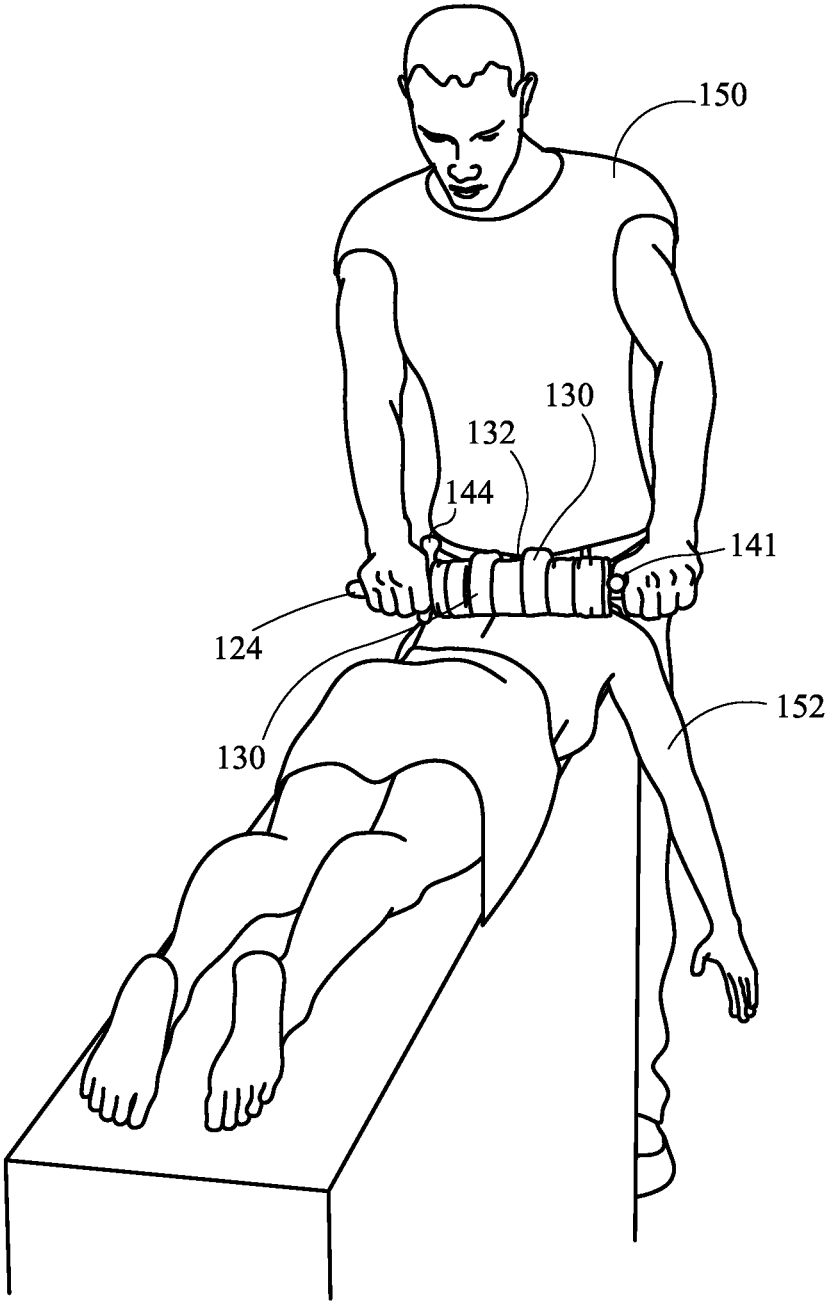
FIG. 4 is an illustrative example of one exercise using an embodiment of the present invention where two stones are nested between smaller diameter spacers with a smaller diameter spacer placed between the stones for use in a rolling massage around the spine.
Figure 5:
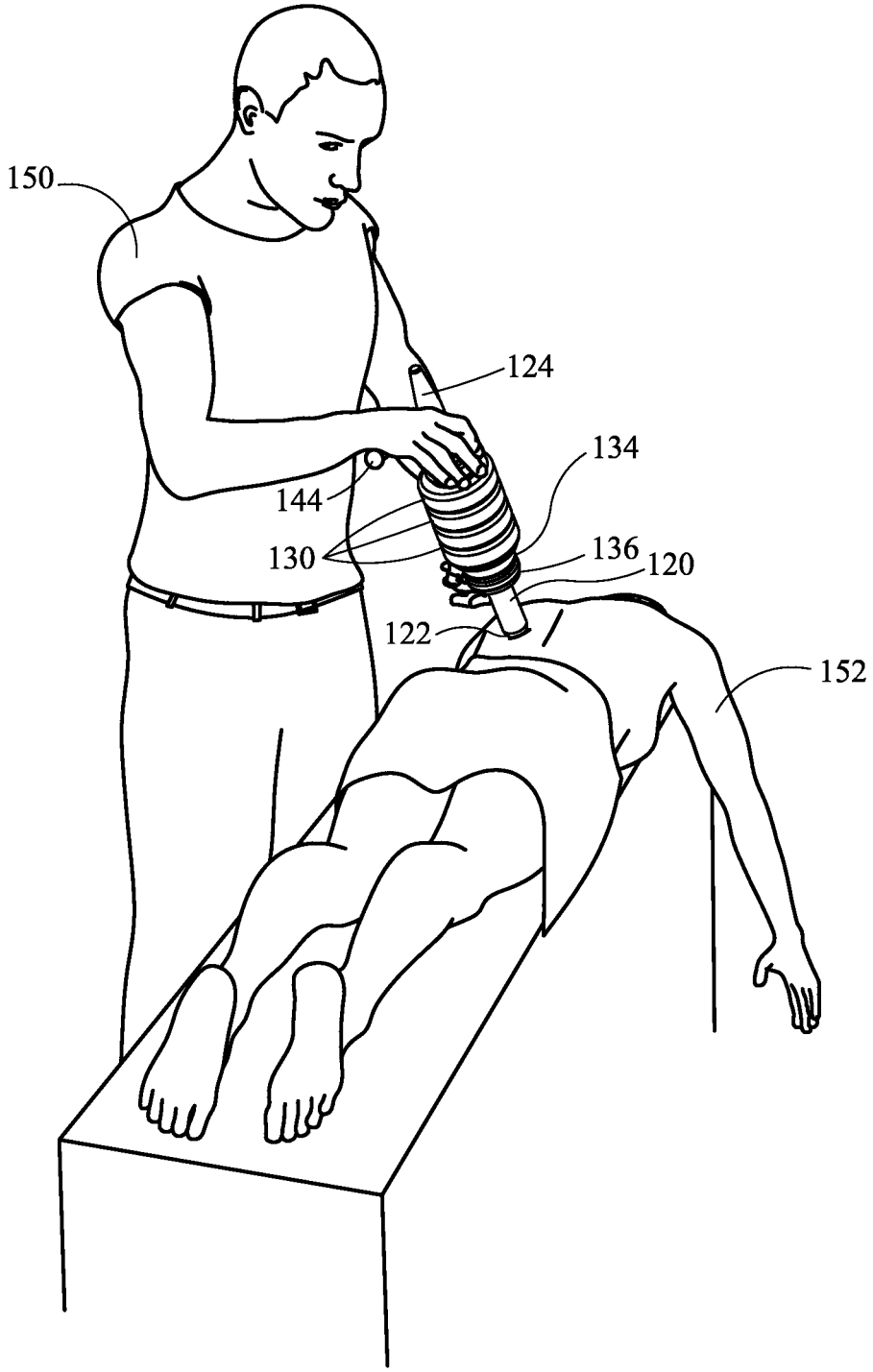
FIG. 5 is an illustrative example of one exercise using an embodiment of the present invention where four stones are nested between smaller diameter spacers for use in a deep tissue massage. A small acupressure pin is inserted into the through-bore at the blunt end of the rod while a long acupressure pin is inserted into the through-bore at the tapered end of the rod.
Figure 6:
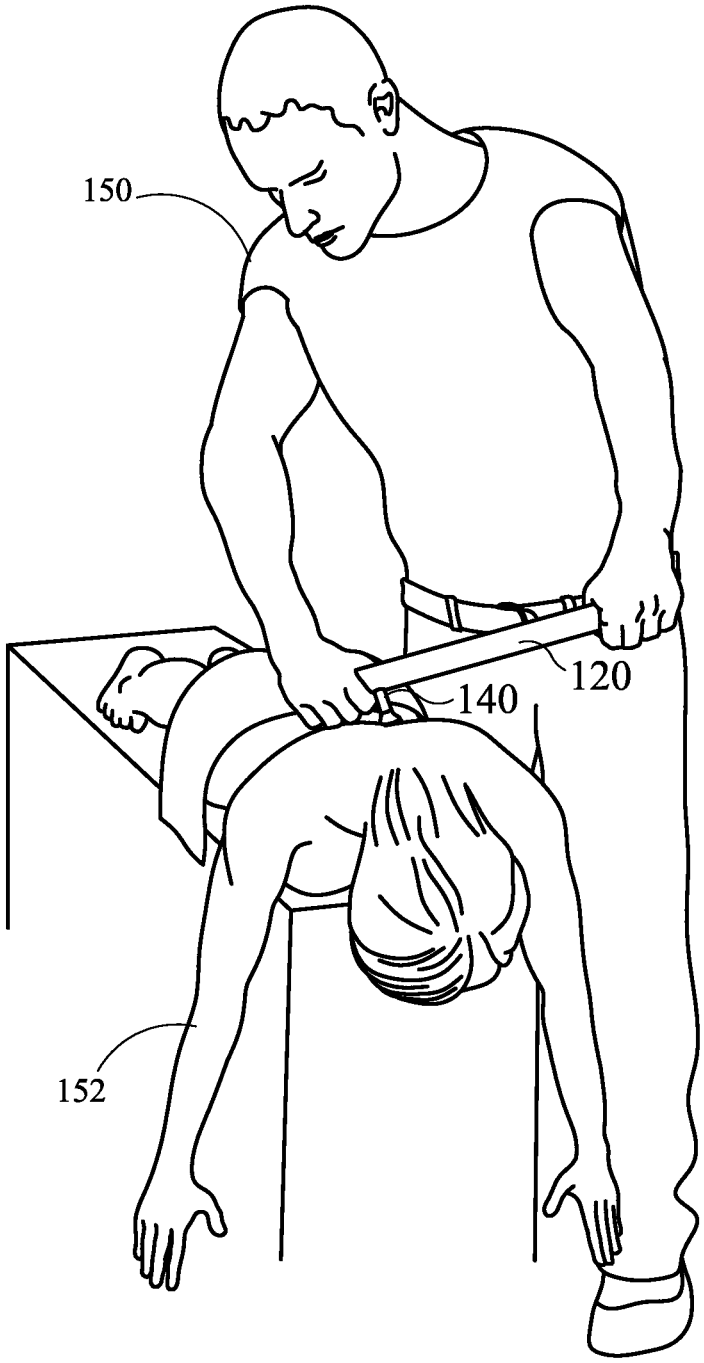
FIG. 6 is an illustrative example of one exercise using an embodiment of the present invention where a short acupressure pin is inserted into the tapered end of the rod with the short acupressure pin used for deep tissue massage.

FIGS. 4 through 6 are illustrative examples of the massage apparatus 100 in use to perform various massage exercises.

FIG. 4 is an illustrative example of a spinal massage exercise using a massage apparatus of one embodiment of the present invention. In this embodiment, two stones 130 are nested between smaller diameter spacers 132, 134, and 136 with smaller diameter spacers 132 and 134 placed between stones 130. Thus, stones 130 are spaced apart from one another causing a valley to be formed between them via the smaller diameter spacers. Stones 130 contact the patient's body while the smaller diameter spacers do not contact patient 152. Thus, therapist 150 is able to massage either side of the spine without directly impacting on the vertebrae. This type of massage is not possible using a traditional rod as the bones of the spine would be pressed by the rod causing patient discomfort and possible injury. Alternatively, therapist 150 could arrange stones 130 and spacers 132, 134, and 136 in such a configuration as to massage one side of the spine using stones 130, while massaging the other side of the spine simultaneously using acupressure pin 144.

As discussed above, stones 130 can be heated, thereby providing a targeted hot stone massage to the spine without requiring the therapist 150 to hold or physically handle the hot stones 130 while also continuously changing the portion of the stone 130 in contact with the patient 152, thereby increasing the amount of time heat is retained in the stone 130 while minimizing the amount of direct heat applied to a single point on the patient 152.

FIG. 5 is an illustrative example of an exercise where two long acupressure pins 144 are inserted into the blind threaded holes of rod 120. In the exercise shown in FIG. 5, the blunt end 122 of the rod 120 is used to perform a deep tissue massage on patient 152. Long acupressure pins 144 are used to increase leverage applied to the blunt end 122 of the rod 120 providing for a deeper, more controlled massage. In addition, stones 130 are used to increase the overall weight of the massage apparatus, thereby allowing therapist 150 to give patient a deep tissue massage while not having to exert as much downward pressure on acupressure pins 144 as would otherwise be necessary. Spacers 134 and 136 are added to rod 120 to keep hot stones 130 away from the therapist's hands, as well as to lock stones 130 in tight between acupressure pins 144. However, any additional combinations of stones and spacers can be used to perform the same exercise.

Similarly, FIG. 6 is an illustrative example of an improved exercise using an embodiment of a massage apparatus of the present invention where short acupressure pin 140 is inserted into a blind threaded hole of rod 120. With this improved apparatus, short acupressure pin 140 is used to conduct deep tissue massage with rod 120 providing additional leverage and control.

An additional exercise (not shown) can occur where rod 120 is used as a rolling rod without removable acupressure pins 140 or 144, removable stones 130, or removable spacers 131, 132, 134, or 136. The rod 120 then functions similarly to current bamboo rod massagers.

Yet another exercise (not shown) using the rod and acupressure pins of the massage apparatus of the present invention is described by long acupressure pin 144 being inserted into the a blind threaded hole of blunt end 122 of rod 120 while short acupressure pin 140 is inserted into a blind threaded hole of tapered end 124 of rod 120. The tapered end of the rod is used to perform massage with the acupressure pins being used to increase user control and the leverage applied to the tapered end.

Still another exercise (not shown) uses only one stone 130 for conducting a massage using an apparatus of one embodiment of the present invention. A stone 130 is nested between smaller diameter spacers 131, 132, 134 and 136 on rod 120. Stone 130 is then rolled on the patient's body to perform a rolling massage. As discussed above, stone 130 can be a heated stone disc, thereby providing a targeted hot stone massage without requiring the therapist to hold or physically handle the hot stone while also continuously changing the portion of the stone in contact with the patient, thereby increasing the amount of time heat is retained in the stone while minimizing the amount of direct heat applied to a single point on the patient.

Another example (not shown) of one exercise using a massage apparatus of one embodiment of the present invention uses four stones 130 nested between smaller diameter spacers 131, 132, 134, and 136. Small acupressure pins 140 are inserted into the blind threaded holes of the rod to hold the stones in place on the rod. The apparatus is then used in a rolling massage, since small acupressure pins 140 do not extend outward from rod 120 beyond the diameter of stones 130. As discussed above, stones 130 can be heated, thereby providing a hot stone massage without requiring the therapist to hold or physically handle the hot stone while also continuously changing the portion of the stone in contact with the patient, thereby increasing the amount of time heat is retained in the stone while minimizing the amount of direct heat applied to a single point on the patient.

Although the disclosure has been described with reference to certain preferred embodiments, it will be appreciated by those skilled in the art that modifications and variations may be made without departing from the spirit and scope of the disclosure. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed:

1. A hot stone therapy and acupressure apparatus comprising:

a rod having an outer diameter, a first end, a second end and a middle section;

a plurality of stones removably mounted on said rod; wherein at least one stone is a larger diameter stone surrounded by at least two smaller diameter stones, wherein the plurality of stones decrease in diameter toward a pair of handles and the at least one larger diameter stone is positioned centrally on the rod, wherein the larger diameter stone comprises a thickness that is larger than a thickness of each of the at least two smaller diameter stones, wherein each of the at least two smaller diameter stones is positioned adjacent to a stone having a thickness that is smaller than the thickness of each of the at least two smaller diameter stones, wherein each stone is shaped as a hollow cylinder defining an interior surface and an exterior surface, said interior surface having a diameter that is slightly larger than the outer diameter of the rod wherein each stone is independently axially movable and positionable along the middle section of the rod, said first end and said second end portions of said rod extending beyond the plurality of stones thereby forming the pair of handles for facilitating gripping the rod and positioning the hot stone therapy and acupressure apparatus across a person's body; and at least one acupressure pin removably mounted to said rod for positioning, removing and replacing the plurality of stones and for applying acupressure to said person's body;

wherein said at least one acupressure pin is a first acupressure pin rotationally offset from a second acupressure pin around a longitudinal axis of the rod to position only one acupressure pin to contact said person's body during use; and wherein each side of the plurality of stones is substantially flat.

2. The hot stone therapy and acupressure apparatus of claim 1, wherein said at least one acupressure pin is threaded to removably screw into at least one blind thread hole in said rod.

3. The hot stone therapy and acupressure apparatus of claim 1, wherein said middle section of said rod is a space between said first acupressure pin and said a second acupressure pin.

4. The hot stone therapy and acupressure apparatus of claim 1, further comprising at least one spacer to separate and position said plurality of stones on said rod.

5. The hot stone therapy and acupressure apparatus of claim 1, wherein said first end of said rod is tapered and wherein said second end of said rod is blunted for applying acupressure to said person's body.

6. The hot stone therapy and acupressure apparatus of claim 1, wherein said at least one acupressure pin has a bulbous end for applying acupressure to said person's body.

7. The hot stone therapy and acupressure apparatus of claim 1, wherein said at least one acupressure pin extends outward from said rod beyond said exterior surface of said plurality of stones.

8. The hot stone therapy and acupressure apparatus of claim 1, wherein said plurality of stones has a specific heat capacity of at least approximately 0.9 J/g K.

9. The hot stone therapy and acupressure apparatus of claim 1, wherein said plurality of stones is made from soapstone.

10. The hot stone therapy and acupressure apparatus of claim 1, wherein said at least one acupressure pin is mounted to said first end of said rod as a lever to apply acupressure to said person's body using said second end of said rod.

11. The hot stone therapy and acupressure apparatus of claim 1, wherein the at least one acupressure pin is rotationally offset from the second acupressure pin by a first angle of at least 45 degrees in a rotational direction around the rod.

12. The hot stone therapy and acupressure apparatus of claim 1, wherein the at least one acupressure pin is rotationally offset from the second acupressure pin by a first angle of approximately 90 degrees in a rotational direction around the rod.

13. The hot stone therapy and acupressure apparatus of claim 1, wherein said plurality of stones are positioned adjacent to each other and capable of contacting each other such that heat is directly exchanged between said plurality of stones.

14. The hot stone therapy and acupressure apparatus of claim 1, wherein the first acupressure pin and the second acupressure pin are configured to be removed to allow removal of stones such that a single stone remains on the rod surrounded by at least two spacers and the rod is configured to be gripped by the user adjacent the at least two spacers during use to reduce a surface area of the stones in contact with a patient to provide greater pressure at an area of a body being treated.

15. A method of hot stone therapy and acupressure comprising the steps of heating an electric griddle to an appropriate temperature for hot stone therapy;

placing a plurality of stones on the electric griddle, wherein two opposing sides of each stones are predominately flat such that the plurality of stones are configured to be heated to the appropriate temperature for hot stone therapy on the electric griddle rapidly;

heating the plurality of stones on the electric griddle to the appropriate temperature for hot stone therapy;

removing the plurality of stones from the electric griddle and mounting the plurality of stones on a rod, wherein the plurality of stones are arranged on the rod such that there is a larger diameter stone surrounded by at least two smaller diameter stones, wherein the plurality of stones decrease in diameter toward a pair of handles of the rod and the at least one larger diameter stone is positioned centrally on the rod, wherein the larger diameter stone comprises a thickness that is larger than a thickness of each of the at least two smaller diameter stones, wherein each of the at least two smaller stones is positioned adjacent to a stone having a thickness that is smaller than the thickness of each of the at least two smaller diameter stones;

securing the plurality of stones on said rod using at least two acupressure pins, wherein the at least two acupressure pins form about a 90 degree angle with an axis of the rod; wherein a first acupressure pin is rotationally offset around the axis of the rod from a second acupressure pin;

massaging a body of a person with said plurality of stones, said rod and one of the at least two acupressure pins.

* * * * *